US007963798B1

(12) United States Patent
Yang

(10) Patent No.: US 7,963,798 B1
(45) Date of Patent: Jun. 21, 2011

(54) ELECTRICAL CONNECTOR WITH LOCKING MEMBER FOR MOUNTING THEREOF TO PRINTED CIRCUIT BOARD

(75) Inventor: Chih-Lin Yang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/750,718

(22) Filed: Mar. 31, 2010

(51) Int. Cl.
*H01R 13/60* (2006.01)

(52) U.S. Cl. ..... 439/567

(58) Field of Classification Search ..... 439/626, 439/567

See application file for complete search history.

(56) References Cited

U.S. PATENT DOCUMENTS 6,565,383 B1 * 5/2003 Wu ..... 439/567
6,629,857 B1 * 10/2003 Ma et al. ..... 439/567
6,648,682 B1 * 11/2003 Wu ..... 439/567
7,878,848 B1 * 2/2011 Yang et al. ..... 439/567
2006/0014422 A1 * 1/2006 Fan ..... 439/567

* cited by examiner

*Primary Examiner* — Edwin A. Leon
*Assistant Examiner* — Vanessa Girardi
(74) *Attorney, Agent, or Firm* — Cheng-Ju Chiang

(57) ABSTRACT

An electrical connector includes an insulating housing, a plurality of contacts and a locking member. A pair of slots is defined in the opposite ends of the housing. A longitudinal groove is formed on a top surface of the housing with two ends connecting the slots respectively. A transversal groove is formed on the top surface and intersects the longitudinal groove perpendicularly. A narrow hole is defined in the transversal groove. The locking member has a main beam and a pair of straight mounting legs. The main beam has a fixed portion extended downwardly from a portion thereof. Each mounting leg passes through the slot. The distal end of the mounting leg extends out of the housing. The main beam is secured in the longitudinal groove. The fixed portion is secured in the narrow hole of the housing.

7 Claims, 4 Drawing Sheets

ELECTRICAL CONNECTOR WITH LOCKING MEMBER FOR MOUNTING THEREOF TO PRINTED CIRCUIT BOARD

BACKGROUND OF THE INVENTION

1. Field of the Invention

The present invention relates to an electrical connector, and particularly to an electrical connector having an improved locking member.

2. The Related Art

The conventional connector which is surface mounting to a printed circuit board generally applies two locking pins to fix a housing of the connector to the printed circuit board. The two locking pins are inserted into two locking pin mounting slots formed at the two side ends of the housing respectively. The locking pin is stamped from a metal sheet and defines a main portion fixed in the locking pin mounting slot. The main portion extends a locking portion, such as two spaced legs, each having a projection at the distal end. The locking portion projects out of the housing and inserts into corresponding locking aperture of the printed circuit board. The projection of the locking pin elastically engaged with the peripheries of the locking aperture so that the connector is fixed firmly onto the printed circuit board.

In order to be secured in the locking pin mounting slot, the main portion has to make a complex fastening structure. Enough material hardness, height and width of the housing are also required. It's difficult to manufacture and the manufacturing cost is increased. In addition, the torque acting on the housing can still cause a slight shaking. In some cases, the housing can even be lifted up from the printed circuit board. As a result, the connection between the connector and the printed circuit board is apt to be broken.

SUMMARY OF THE INVENTION

Accordingly, an object of the present invention is to provide an electrical connector having an improved locking member.

In order to achieve the objects set forth, according to the present invention, there is provided an electrical connector for mounting on a top surface of a printed circuit board, comprises an insulating housing, a plurality of contacts and a locking member. The insulating housing defines a front surface, a rear surface, a top surface and a mounting surface perpendicularly connecting with the front surface and the rear surface. The front surface provides a plurality of contact receiving cavities spaced from one another. A pair of slots is defined in two opposite ends of the housing. The slot extends downwardly from the top surface through the mounting surface. A longitudinal groove is formed on the top surface and extends along a direction perpendicular to the frontward and rearward direction with two ends connecting the slots respectively. A transversal groove is formed on the top surface and intersects the longitudinal groove perpendicularly with a common center portion. A narrow hole is defined in the transversal groove. The contacts received in the contact receiving cavities respectively. The locking member has a main beam and a pair of straight mounting legs. The mounting legs extend downwardly from two ends of the main beam respectively and parallel to each other. Two spaced engaging projections are formed at opposite sides of a distal end of the mounting leg and extend outside. The main beam has a fixed portion extended downwardly from a portion thereof. Each mounting leg of the locking member passes through the slot of the housing from the top surface to the mounting surface.

The distal end of the mounting leg extends out of the mounting surface and then passes an opening of the printed circuit board aligning with the slot of the housing. The engaging projection bears against a bottom surface of the printed circuit board. The main beam of the locking member is secured in the longitudinal groove of the housing which is sized to receive and retain the main beam. The fixed portion is secured in the narrow hole of the housing.

As described above, the locking member is easy to manufacture. In addition, the locking member is inserted into the housing. The main beam of the locking member extends substantially across the housing and presses the housing on the printed circuit board. So the housing is fastened tightly onto the printed circuit board. And the fixed portion can further improve the retention and restricts the shaking of the housing.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
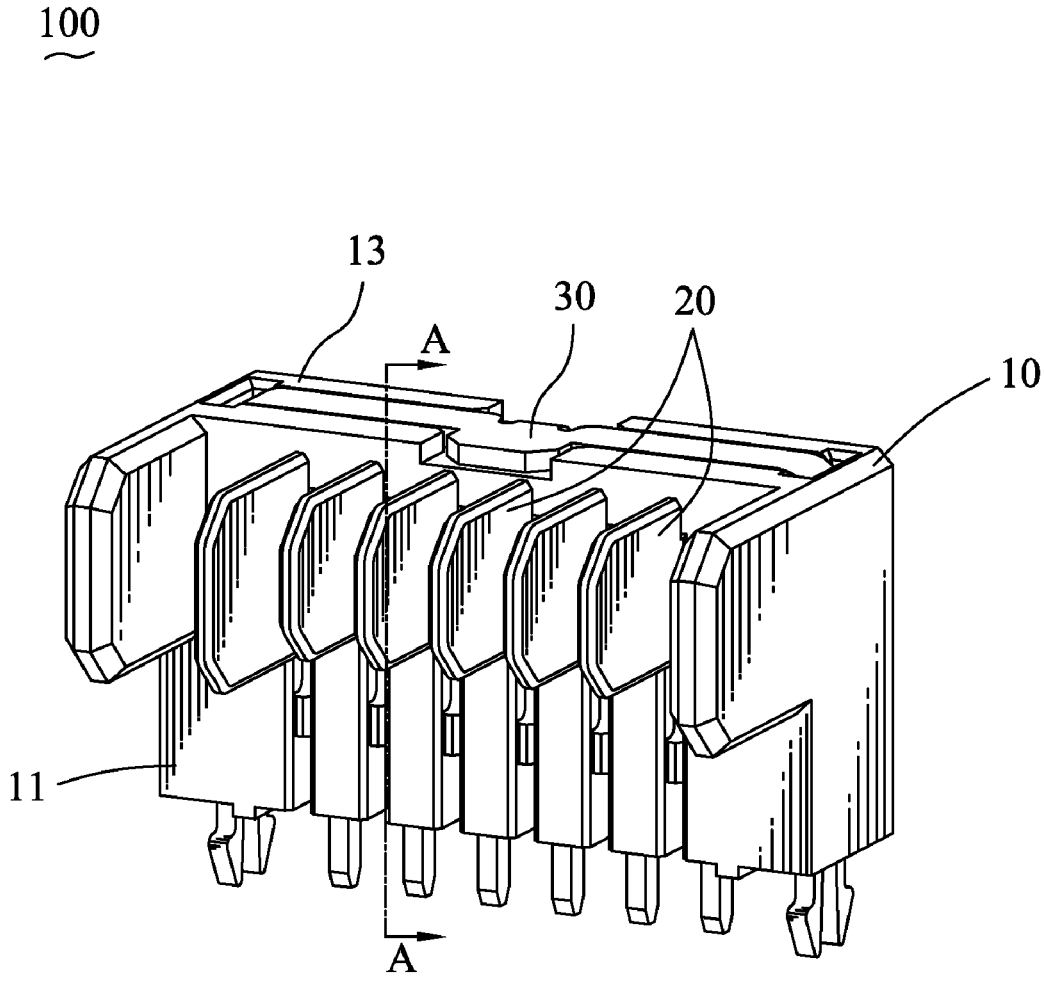
FIG. 1 is a perspective view of an electrical connector in accordance with the present invention.
Figure 2:
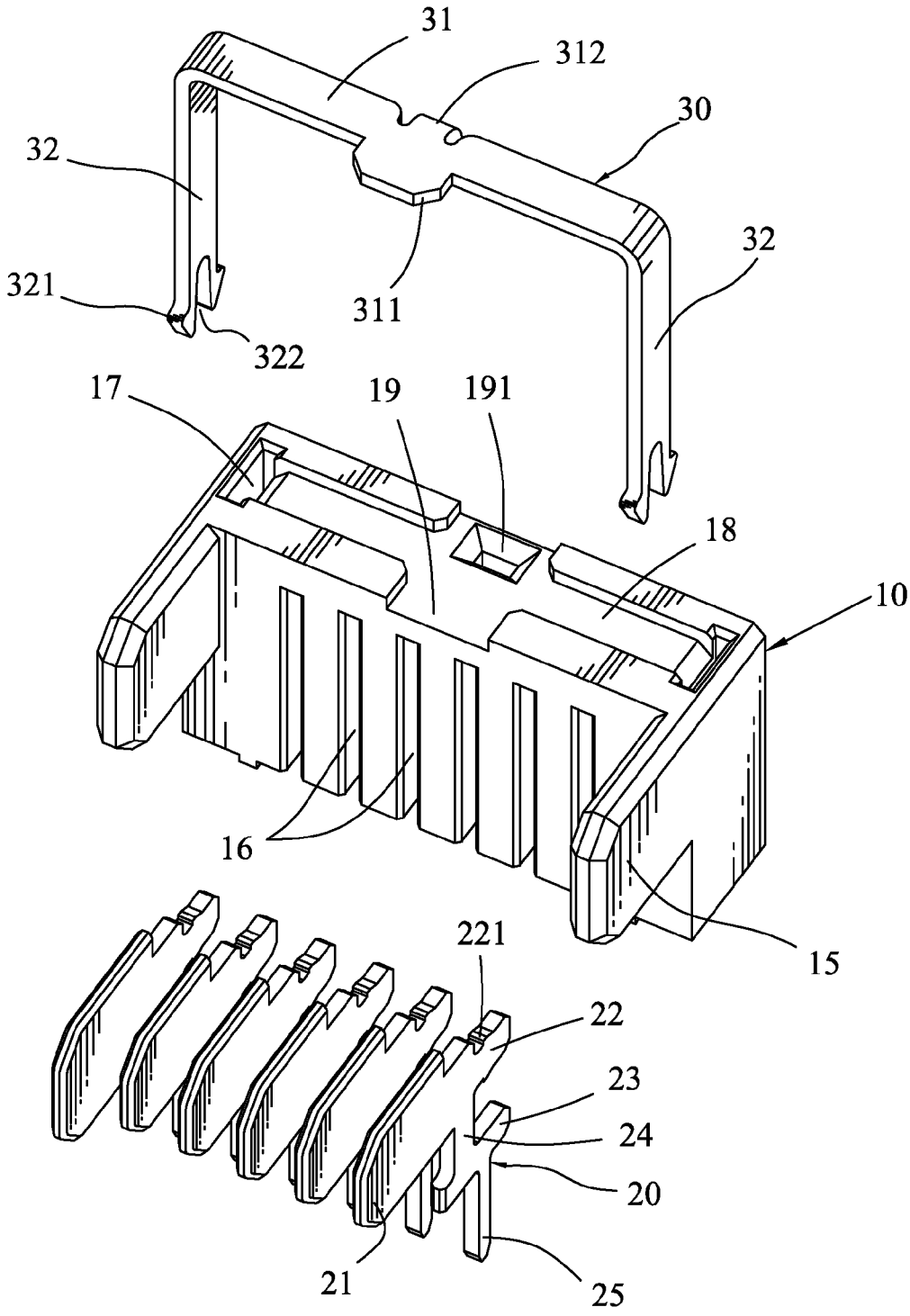
FIG. 2 is an exploded, perspective view of the electrical connector shown in FIG. 1.
Figure 3:
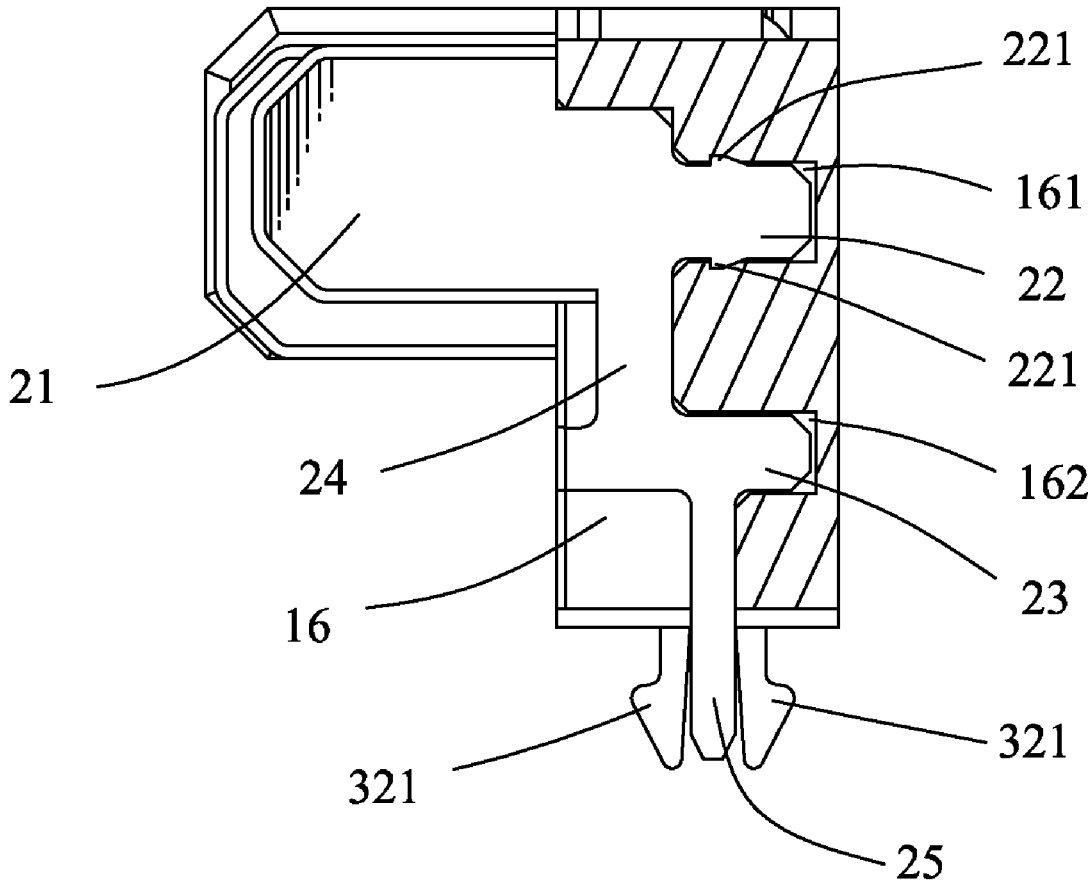
FIG. 3 is a cross-sectional view of the electrical connector shown in FIG. 1.

Referring to the drawings in greater detail, and first to FIGS. 1 and 2, the embodiment of the invention is shown as an electrical connector 100 adapted for mounting on a printed circuit board (not shown). The electrical connector 100 comprises an insulating housing 10, a plurality of contacts 20 received in the housing 10 and a locking member 30 for mounting the housing 10 on the printed circuit board (not shown). The housing 10 is in an approximately rectangular parallelepiped shape and has a front surface 11, a rear surface 12, a top surface 13 and a mounting surface 14 perpendicularly connecting with the front surface 11 and the rear surface 12. A pair of wings 15 protrudes forwardly from two opposite ends of the front surface 11. A plurality of contact receiving cavities 16 are provided in the front surface 11 side by side for receiving the contacts 20 and open to the mounting surface 14. The contact receiving cavities 16 extend perpendicular to the mounting surface 14 and are spaced from each other. Referring to FIG. 3, an upper recess 161 and a lower recess 162 are extended rearwardly from a rear side surface of the contact receiving cavity 16 without penetrating the rear surface 12 of the housing 10, and the lower recess 162 is located just below the upper recess 161.

Figure 4:
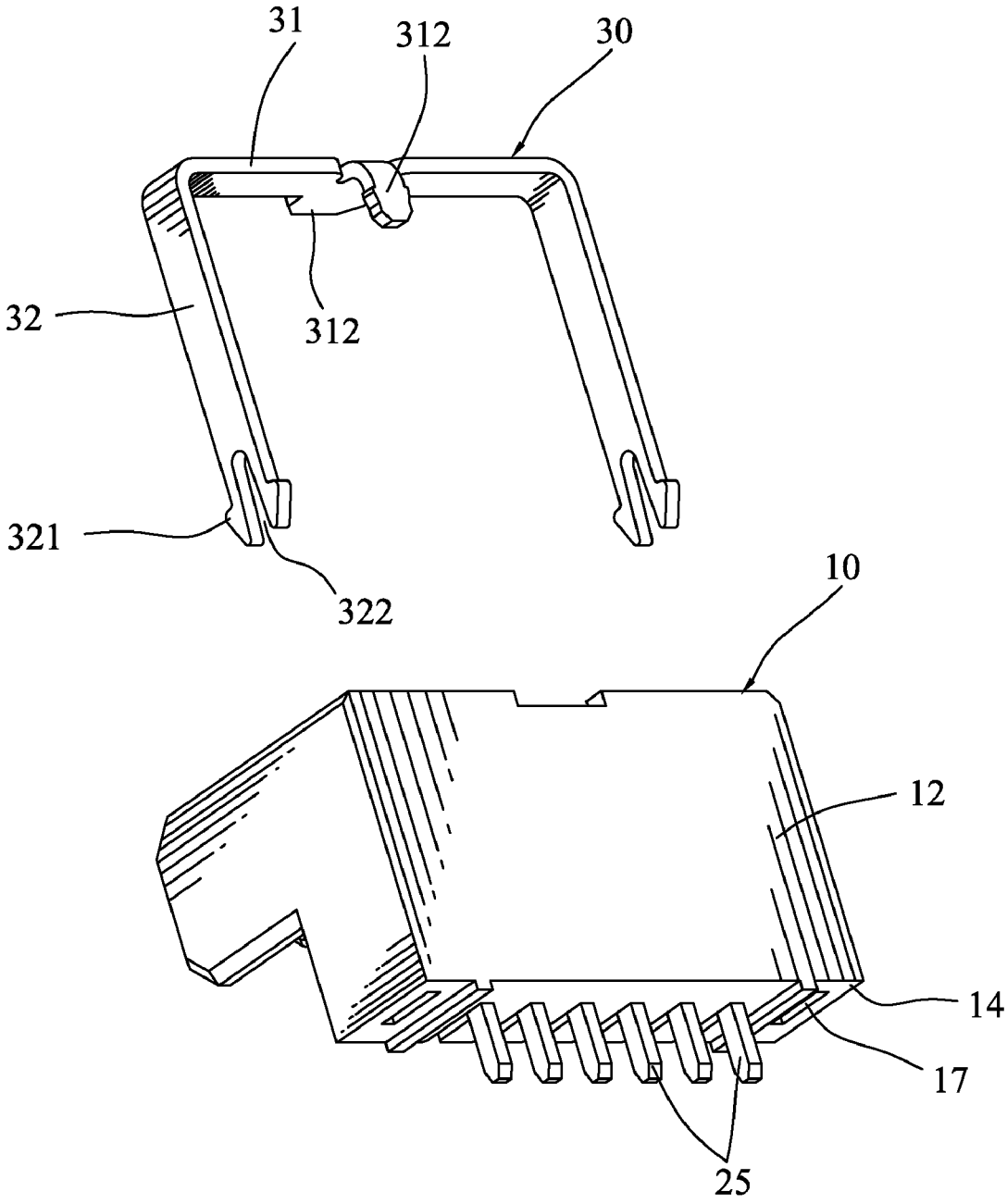
FIG. 4 is an exploded, perspective view of the electrical connector shown in FIG. 1 viewed from rear angle.

As shown in the FIGS. 1, 2 and 4, a pair of slots 17 is defined in two opposite ends of the housing 10. Each slot 17 extends downwardly from the top surface 13 through the mounting surface 14. A longitudinal groove 18 is formed on the top surface 13 and extends lengthwise along the housing 10 with two ends connecting the slots 17 respectively. In addition, a transversal groove 19 is also formed on the top surface 13 and intersects the longitudinal groove 18 perpendicularly with a common center portion. The transversal groove 19 defines a narrow hole 191 at a rear portion of a bottom thereof.

The contacts 20 are formed by stamping a metal sheet. As shown in FIGS. 2 and 3, each contact 20 includes a contact portion 21. The contact portion 21 is a substantially vertical big rectangular block. An upper fixed portion 22 protrudes from a rear edge of the contact portion 21. The upper and the lower edge of the upper fixed portion 22 each has a barb 221 protruding outside. A lower fixed portion 23 is formed under the upper fixed portion 22 and connected to the junction of the contact portion 21 and the upper fixed portion 22 through a bar 24. Rear ends of the upper fixed portion 22 and the lower fixed portion 23 are flush with each other. A soldering tail 25 connects to a bottom edge of the lower fixed portion 23 and extends downwardly therefrom.

As shown in the FIGS. 2 and 4, the locking member 30 is substantially U-shaped and stamped from a metal stock. It has a flat main beam 31 and a pair of straight mounting legs 32. The mounting legs 32 extend downwardly from two ends of the main beam 31 respectively and are parallel to each other. Two spaced engaging projections 321 are formed at opposite sides of a distal end of the mounting leg 32 and extend outside. A slit 322 is defined between the two engaging projections 321 in order to facilitate an elastic deformation. The main beam 31 has a tab 311 extended forwardly from a middle part thereof and a fixed portion 312, at an opposite side thereof, extended downwardly for engaging the narrow hole 191.

In assembly, each contact 20 is inserted into the corresponding contact receiving cavity 16. Most of the contact portion 21 protrudes outside from the front surface 11 of the insulating housing 10, and is adapted for engaging with a terminal of a mating connector (not shown). The upper fixed portion 22 and the lower fixed portion 23 are respectively inserted into the upper recess 161 and the lower recess 162. Furthermore, the upper fixed portion 22 is buckled in the upper recess 161. The soldering tail 25 extends beyond the mounting surface 14 so as to be soldered to the printed circuit board (not shown).

The locking member 30 is inserted into the housing 10. Each mounting leg 32 of the locking member 30 passes through the slot 17 of the housing 10 from the top surface 13 to the mounting surface 14. Moreover, the distal end of the mounting leg 32 which has two spaced engaging projections 321 extends out of the mounting surface 14 and then passes an opening of the printed circuit board (not shown) aligning with the slot 17 of the housing 10. The engaging projection 321 bears against a bottom surface of the printed circuit board (not shown) in order to fix the housing 10 on the printed circuit board (not shown). Furthermore, the main beam 31 of the locking member 30 is secured in the longitudinal groove 18 of the housing 10 which is sized to receive and retain the main beam 31. The tab 311 of the main beam 31 is placed in the transversal groove 19. And besides, the fixed portion 312 is secured in the narrow hole 191 of the housing 10. So the locking member 30 is embedded in the housing 10. The plane of the main beam 31, mounting leg 32 and the fixed portion 312 are perpendicular each other. It can restrict a shaking in different directions and prevent the housing 10 from lifting up. As a result, the housing 10 is firmly fixed on the printed circuit board (not shown).

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector for mounting on a top surface of a printed circuit board, comprising:

an insulating housing defining a front surface, a rear surface, a top surface and a mounting surface perpendicularly connecting with the front surface and the rear surface, the front surface providing a plurality of contact receiving cavities spaced from one another, a pair of slots defined in two opposite ends of the housing, the slot extending downwardly from the top surface through the mounting surface, a longitudinal groove formed on the top surface and extending along a direction perpendicular to the frontward and rearward direction with two ends connecting the slots respectively, a transversal groove formed on the top surface and intersecting the longitudinal groove perpendicularly with a common center portion, a narrow hole defined in the transversal groove;

a plurality of contacts received in the contact receiving cavities respectively;

a locking member having a main beam and a pair of straight mounting legs, the mounting legs extending downwardly from two ends of the main beam respectively and being parallel to each other, two spaced engaging projections formed at opposite sides of a distal end of the mounting leg and extending outside, the main beam having a fixed portion extended downwardly from a portion thereof; wherein each mounting leg of the locking member passes through the slot of the housing from the top surface to the mounting surface, the distal end of the mounting leg extends out of the mounting surface and then passes an opening of the printed circuit board aligning with the slot of the housing, the engaging projection bears against a bottom surface of the printed circuit board, the main beam of the locking member is secured in the longitudinal groove of the housing which is sized to receive and retain the main beam, the fixed portion is secured in the narrow hole of the housing.

2. The electrical connector as claimed in claim 1, wherein the distal end of the mounting leg is defined a slit between the two engaging projections.

3. The electrical connector as claimed in claim 1, wherein the housing is defined an upper recess and a lower recess extended rearwardly from a rear side surface of the contact receiving cavity without penetrating the rear surface of the housing, the lower recess is located just below the upper recess, the contact includes a contact portion, an upper fixed portion, a lower fixed portion and a soldering tail, the upper fixed portion connects a rear edge of the contact portion, the lower fixed portion is formed under the upper fixed portion and connected to the junction of the contact portion and the upper fixed portion through a bar, the upper fixed portion is inserted into the upper recess, the lower fixed portion is inserted into the lower recess, the soldering tail connects to a bottom edge of the lower fixed portion and extends downwardly therefrom.

4. The electrical connector as claimed in claim 3, wherein rear ends of the upper fixed portion and the lower fixed portion are flush with each other.

5. The electrical connector as claimed in claim 1, wherein the narrow hole is positioned at a rear portion of a bottom of the transversal groove, the fixed portion is extended downwardly from a middle part of a rear side of the main beam.

6. The electrical connector as claimed in claim 5, wherein the plane of the main beam, the mounting leg and the fixed portion are perpendicular each other.

7. The electrical connector as claimed in claim 6, wherein the main beam further has a tab extended forwardly at an opposite side of the fixed portion, the tab is located in the transversal groove with two sides close to sidewalls of the transversal groove.

* * * * *